United States Patent [19]

Giurlando et al.

[11] 4,058,361

[45] Nov. 15, 1977

[54] REFRIGERANT COMPRESSOR HAVING INDIRECT OUTLET CONNECTION

[75] Inventors: Angelo C. Giurlando, Sommerville; David Richardson, Flemington, both of N.J.

[73] Assignee: Fedders Corporation, Edison, N.J.

[21] Appl. No.: 552,189

[22] Filed: Feb. 24, 1975

[51] Int. Cl.[2] ..... F04B 21/00

[52] U.S. Cl. ..... 417/312; 417/369; 417/902; 62/296

[58] Field of Search ..... 417/369, 312, 902, 410; 62/296, 505

[56] References Cited

U.S. PATENT DOCUMENTS

| | | | |
|---|---|---|---|
| 2,979,917 | 4/1961 | Meagher | 62/505 |
| 3,031,861 | 5/1962 | McCormack | 417/312 |
| 3,187,996 | 6/1965 | Roelsgaard | 417/312 |
| 3,402,571 | 9/1968 | Warner | 62/505 |
| 3,698,839 | 10/1972 | Distefano | 417/369 |
| 3,807,907 | 4/1974 | Gannaway | 417/312 |
| 3,934,967 | 1/1976 | Gannaway | 417/312 |

*Primary Examiner*—Carlton R. Croyle
*Assistant Examiner*—Thomas I. Ross
*Attorney, Agent, or Firm*—McAulay, Fields, Fisher & Goldstein

[57] ABSTRACT

A compressor construction is provided which includes a sealed housing having a motor and a compressor unit connected in driving relationship with the motor. The compressor unit is provided with an inlet port which is adapted to receive low pressure fluid therethrough and an outlet port through which the fluid passes under high pressure. The housing includes a housing inlet port that is connected to the compressor unit inlet port through an appropriate conduit. Additionally, a housing outlet port is provided that is aligned with the compressor unit outlet port. However, no direct connection is provided between the compressor unit outlet port and the housing outlet port, thereby providing a compressor construction which substantially eliminates the hydraulic hammer effect and noisy operation of prior compressor constructions.

2 Claims, 3 Drawing Figures

REFRIGERANT COMPRESSOR HAVING INDIRECT OUTLET CONNECTION

This invention relates generally to a compressor construction and, more particularly, pertains to a compressor construction in which the compressor unit outlet port is indirectly connected to the housing outlet port thereby to eliminate the hydraulic hammer effect and noisy operation usually attendant in compressor units of the type under consideration.

Refrigerant compressors and the like usually include a cyclically operating compressor unit that is operable to periodically compress the refrigerant fluid to impart a high pressure thereto. In other words, the fluid from the low pressure refrigerating line is connected to the inlet port of the compressor unit. The compressor unit, which maybe a rotary compressor, is operable to force the refrigerating fluid out of an outlet port under high pressure. In conventional constructions, the compressor unit and its drive motor is received within a sealed housing and appropriate conduits connect the compressor unit inlet and outlet ports to corresponding inlet and outlet ports in the side wall of the housing to provide passages through the housing to and from the compressor unit. However, in practice it has been found that several disadvantages are associated with the aforementioned constructions.

To be more specific, the inlet end of a desuperheater coil is connected to the outlet port of the housing. Due to the cyclical nature of the operation of the compressor unit, the high pressure fluid is applied as a pulsating fluid to desuperheater coils. As a result, a hydraulic hammer effect is experienced by the desuperheater coil, which is commonly referred to as "slugging", which eventually results in damage to the desuperheater coil. Additionally, the pulsating fluid substantially increases the overall noise level of operation of the compressor.

Accordingly, an object of the present invention is to provide an improved compressor construction.

A more specific object of this invention is to provide a compressor construction that is highly efficient and reliable in operation.

Another object of the present invention is to provide a compressor construction in which the hydraulic hammer effect of the refrigerating fluid is substantially decreased.

A further object of the present invention resides in the novel details of construction that provide a compressor construction of the type described that is quiet in operation.

Accordingly, a compressor construction fabricated in accordance with the present invention comprises a sealed housing that receives a motor and a compressor unit therein which is connected in driving relationship with the motor. The compressor unit is provided with an inlet port that is adapted to receive a low pressure fluid therethrough and an outlet port for the passage of high pressure fluid therethrough. The housing has a housing inlet port that is connected to the compressor unit inlet port through a conduit which provides a passage for the flow of the low pressure fluid. A housing outlet port is aligned with the compressor unit outlet port and is in spaced relation thereto. A conduit is connected to the housing outlet port and terminates short of the compressor unit to eliminate any direct connection therebetween thereby substantially reducing the hydraulic hammer effect encountered in prior constructions.

Other features and advantages of the present invention will become more apparent from a consideration of the following detailed description when taken in conjunction with the accompanying drawing, in which.

Figure 1:
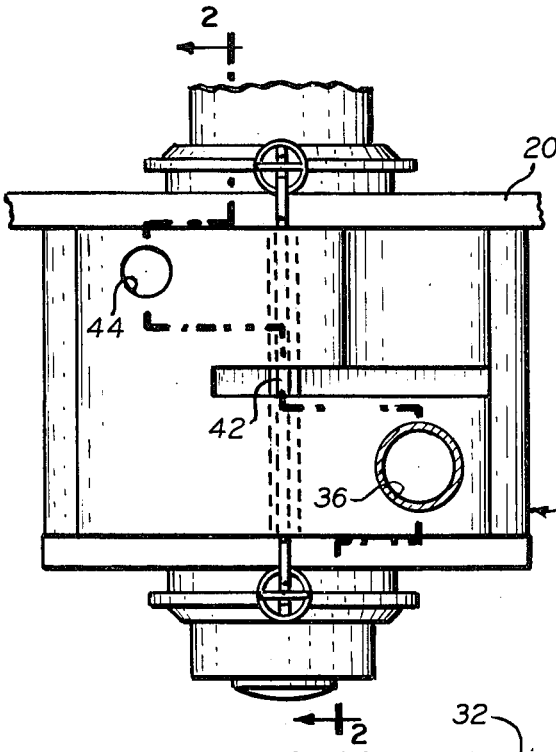
FIG. 1 is a rear elevational view of a compressor unit, with parts broken away in the interests of clarity, taken along the line 1—1 of FIG. 2.
Figure 3:
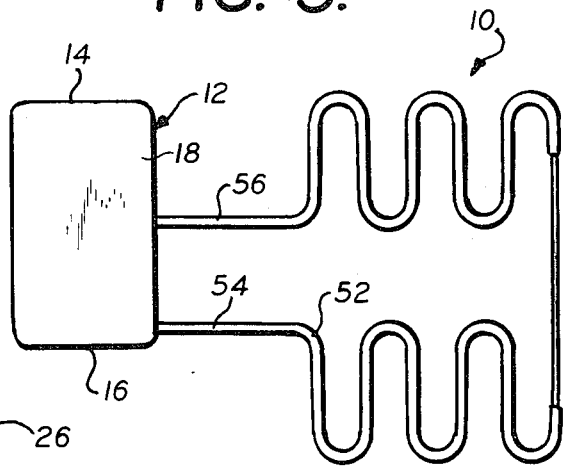
FIG. 3 is a diagrammatic representation of a portion of the compressor system constructed according to the present invention.
Figure 2:
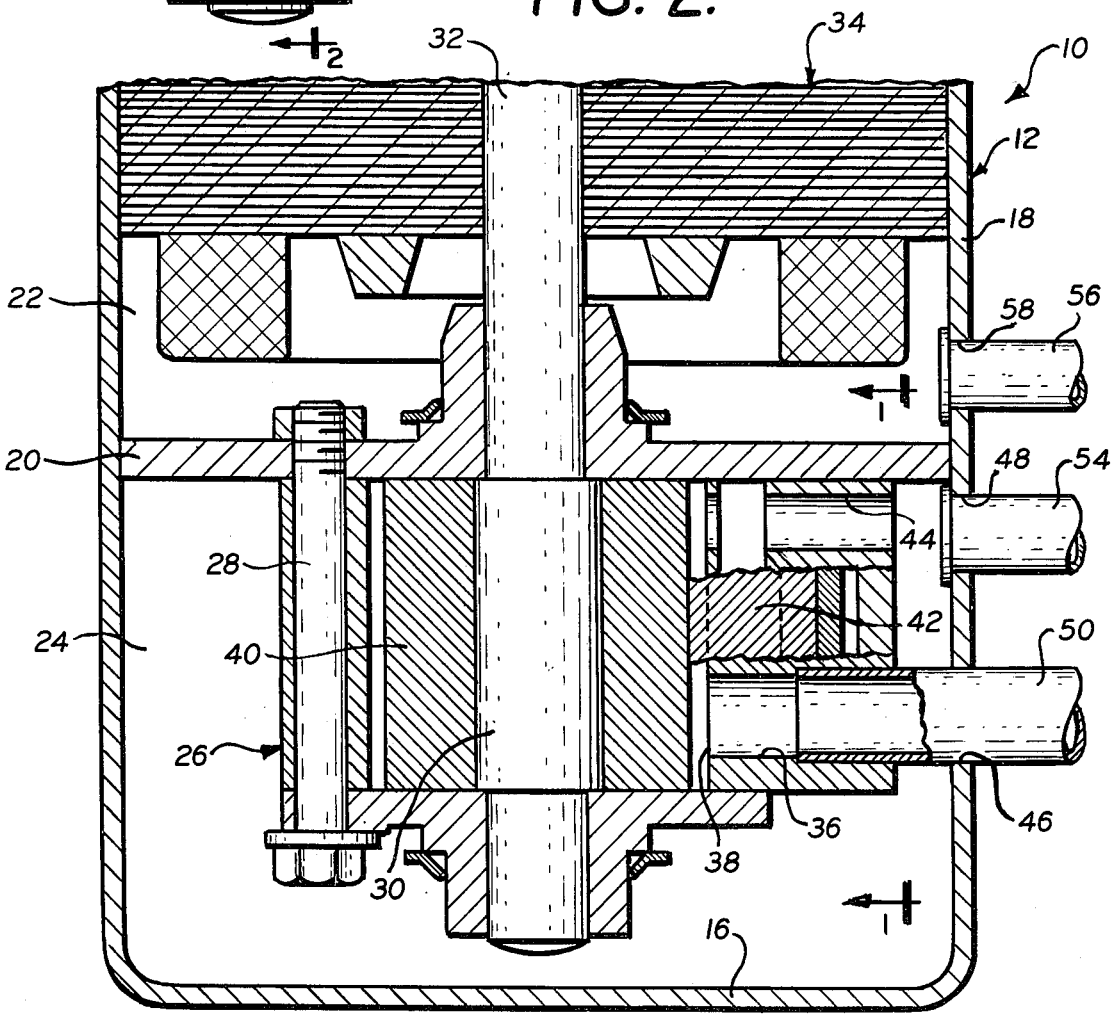
FIG. 2 is a vertical sectional view of a compressor constructed according to the present invention, with parts broken away in the interests of clarity, and illustrating the compressor unit as taken along line 2—2 of FIG. 1.

A compressor constructed according to the present invention is designated generally by the reference numeral 10 and comprises a sealed housing 12 having a top wall 14, a bottom wall 16 and a peripheral side wall 18. As is conventional, the housing 12 is hermetically sealed and includes a horizontally disposed bracket 20 that separates the interior of the housing into an upper motor compartment 22 and a lower compressor unit compartment 24. Received within the compressor unit compartment 24 is a compressor unit designated generally by the reference numeral 26. The compressor unit is connected to and supported by the bracket 20 by means such as screws 28. The compressor unit includes a shaft 30 that extends upwardly through the bracket 20 into the motor compartment 22 and is drivingly connected with an output shaft 32 of a motor 34 received within the motor compartment.

The construction thus far described is conventional and may be of the type described and shown in U.S. patent application Ser. No. 406,274, filed Oct. 15, 1973, entitled Method of Compressor Assembly, invented by Clarence V. Pestel and assigned to the assignee of the present invention, now U.S. Pat. No. 3,872,562. Reference is made to the aforementioned patent application for a more detailed explanation of the compressor unit and motor construction. Briefly, the compressor unit 26 is provided with an inlet port 36 that communicates with an interior chamber 38, it being understood that appropriate valve mechanisms are not shown for purposes of clarity. The refrigerant fluid under low pressure from the refrigerant line flows through the inlet port 36 and into the chamber 38 in which is located a rotor 40 that is drivingly connected with the shaft 30. A spring-biased vane 42 rides on the surface of the rotor and functions as a partition to divide the chamber 38 into a low pressure side and a high pressure side. As the rotor 40 rotates under the influence of the motor 34, the refrigerant fluid under high pressure is forced through an outlet port 44 located adjacent the upper surface of the compressor unit.

In order to permit the introduction of the refrigerant fluid into the housing and to permit exit of the fluid therefrom, the housing 12 is provided with a housing inlet port 46 and a housing outlet port 48. A conduit 50 extends through the housing inlet port 46 and is connected with the compressor unit inlet port 36 to provide a passage for the flow of the low pressure refrigerating fluid from the refrigerating lines. In conventional constructions, the compressor unit outlet port 44 was connected to the inlet of a desuperheater coil such as desuperheater coil 52 through the housing outlet port 48 by an appropriate conduit. However, in accordance with the present invention, a conduit 54 connects the desuperheater coil to the housing outlet port 48 and terminates thereat in spaced and facing relationship to the outlet port 44 of the compressor unit. The housing outlet port 48 and, therefore, the passage provided by the conduit 54 is in alignment with the outlet port 44. Accordingly, it has been found that this particular construction wherein no direct connection is provided between the outlet port 44 of the compressor unit and the outlet port of the housing provides a compressor wherein the hydraulic hammer effect is substantially eliminated in desuperheater coil 52. Moreover, the overall operation of the compressor 10 is substantially less noisy in the present invention that with prior constructions wherein the conduit 54 extended to the inlet port 44 of the compressor unit.

The outlet of the desuperheater coil 52 is connected by a conduit 56 to a port 58 located adjacent the bottom of the motor compartment 22.

In operation, low pressure refrigerant fluid flows through the conduit 50 into the chamber or compartment 38 in the compressor unit 26. The compressor compresses the fluid and causes the same to exit through the outlet port 44 under high pressure. Since the fluid is under high pressure, it flows through the conduit 54 and traverses the desuperheater coil 52. As the fluid flows through the desuperheater coil, the temperature of the fluid is decreased. The fluid flows up through the motor compartment in the conventional manner and cools the motor windings and exits through a conduit (not shown) in the top of the housing.

Accordingly, a rotary compressor has been disclosed in which the hydraulic hammer effect has been substantially eliminated.

While a preferred embodiment of the invention has been shown and described herein numerous omissions, changes and additions may be made in such embodiment without departing from spirit and scope of the present invention.

What is claimed is:

1. A compressor construction comprising a sealed housing having a motor compartment and a compressor compartment; a motor in said motor compartment; a rotary compressor in said compressor compartment connected in driving relationship with said motor for compressing refrigerant fluid, said compressor unit having an inlet port adapted to receive low pressure fluid therethrough and an outlet port for the passage of high pressure fluid therethrough; said housing having a housing inlet port; a conduit extending between said housing inlet port and said compressor inlet port to provide a passage for the low pressure fluid; a housing outlet port in said compressor compartment aligned with said compressor outlet and in spaced relationship thereto whereby said compressor refrigerant fluid is discharged from said compressor unit outlet port into said compressor compartment; and a desuperheater coil connected between said housing outlet port in said compressor compartment and said motor compartment, said desuperheater coil comprising a conduit connected to said housing outlet port and terminating short of said compressor unit to eliminate any direct connection therebetween.

2. A compressor construction as in claim 1 in which said housing further comprises a motor compartment inlet port adjacent the bottom of said motor compartment connected to said desuperheater coil.

* * * * *